United States Patent [19]

Williams et al.

[11] Patent Number: 4,586,916

[45] Date of Patent: May 6, 1986

[54] CORRUGATED CARTON SEPARATOR

[75] Inventors: Donald H. Williams, Adams; LeRoy Jones, Sr., Oxford, both of Wis.

[73] Assignee: Consolidated Papers, Inc., Wisconsin Rapids, Wis.

[21] Appl. No.: 696,507

[22] Filed: Jan. 30, 1985

[51] Int. Cl.[4] ..... B26F 3/02; B31B 1/00

[52] U.S. Cl. ..... 493/10; 493/343; 493/56; 493/372; 225/3; 225/101; 225/99

[58] Field of Search ..... 493/56, 343, 84, 61, 493/62, 372, 10, 22, 29; 225/3, 101, 99; 271/99

[56] References Cited

U.S. PATENT DOCUMENTS

| | | | |
|---|---|---|---|
| 2,579,835 | 12/1951 | Lather | 225/101 |
| 2,693,742 | 11/1954 | Hartman | 225/99 |
| 2,942,765 | 6/1960 | Baumgartner | 225/99 |
| 3,190,516 | 6/1965 | Eriksen | 225/101 |
| 3,212,772 | 10/1965 | Ward | 271/99 |
| 3,926,425 | 12/1975 | Pierce et al. | 493/10 |
| 3,941,372 | 3/1976 | Matsuo | 271/95 |

*Primary Examiner*—Francis S. Husar
*Assistant Examiner*—William E. Terrell
*Attorney, Agent, or Firm*—Gary, Juettner & Pyle

[57] ABSTRACT

Apparatus for separating folded two-on cartons is characterized by a carton supply station for advancing cartons seriatim to a separating station. At the separating station, opposite edges of each carton are gripped and first moved away from each other to pull the two-on carton apart into two separate cartons, and then moved toward each other to bring the separated cartons back together. The separated cartons are then conveyed out of the separating station while the supply station simultaneously advances the next successive two-on carton to the separating station.

12 Claims, 4 Drawing Figures

20
22
24
26
28
30
32
34
38
40
42
56
62
64
66
82
88
90
92
102
104
106
108
110
112
114
116
118
122
2
2

CORRUGATED CARTON SEPARATOR

BACKGROUND OF THE INVENTION

The present invention relates to separation of sheet material, and in particular to a method and apparatus for automatically separating folded two-on type corrugated cartons.

As is known, a two-on corrugated carton comprises two cartons which are manufactured as a unitary structure but are adapted to be detached one from the other into two separate cartons. In its manufacture, a two-on carton is initially die stamped from a sheet of corrugated material, and then glued and folded to a flat configuration. At this point, the two cartons of the two-on carton are releasably connected by small bridges of material extending between adjacent edges thereof, and if the two-on carton is gripped along its opposite edges and pulled apart, the bridges will tear and the two cartons will be separated one from the other. Conventionally, two-on cartons are manually separated, which is time consuming where large numbers of cartons are involved and can require considerable strength and be unwieldy with relatively large cartons.

OBJECT OF THE INVENTION

The primary object of the present invention is to provide a method and apparatus which permits two-on cartons to be automatically separated into two individual cartons in an efficient manner with only minimal intervention of an operator and regardless of the dimensional sizes of the cartons.

SUMMARY OF THE INVENTION

In accordance with the present invention, apparatus for separating folded two-on corrugated cartons comprises a carton supply station for receiving a stack of the cartons. A first conveyor means advances the cartons seriatim from the supply station to a second conveyor means of a carton separating station, which carries each individual carton to a position whereat its opposite edges are received between a pair of clamps. Means are provided for actuating the clamps to grip opposite edges of the carton, for moving the clamps away from and toward each other to pull the two-on carton apart into two separate cartons and to then bring the separated cartons back together, and for thereafter releasing the clamps. After separation, the second conveyor means is operated to carry the now separate cartons out of the separating station for collection while the first conveyor means is simultaneously operated to carry the next successive two-on carton to the second conveyor means of the separating station.

According to the method of the invention, two-on cartons are advanced seriatim to a separating station whereat opposite edges of each carton are gripped and pulled apart to separate the two-on carton into two individual cartons, and the edges are then moved back toward each other to move the separated cartons back together. After the separating step, the separated cartons are advanced out of the separating station and collected and the next successive two-on carton is advanced to the separating station, whereupon the above steps are repeated.

The foregoing and other objects, advantages and features of the invention will become apparent upon a consideration of the following detailed description, when taken in conjunction with the accompanying drawings.

DETAILED DESCRIPTION

Figure 1:
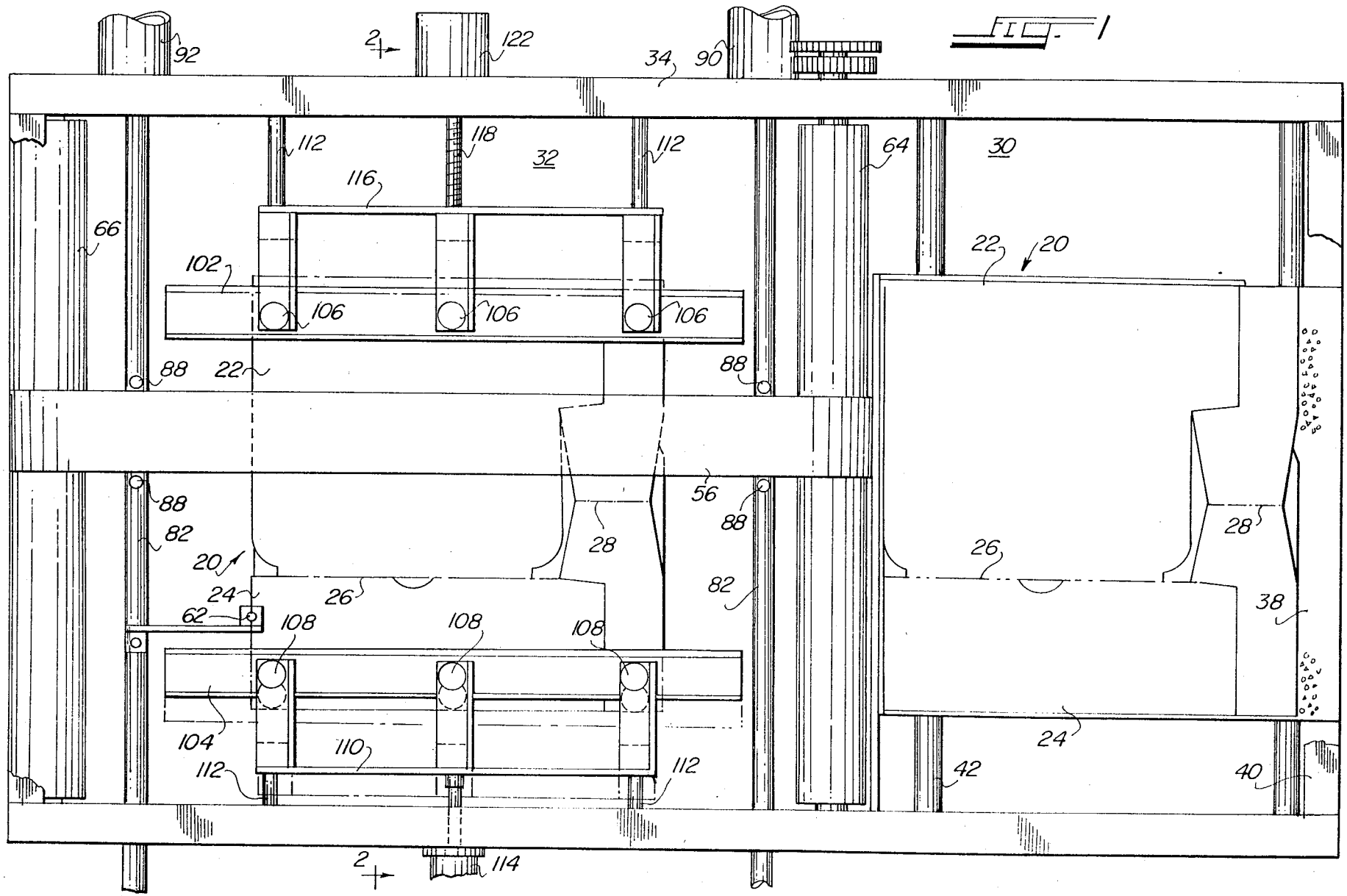
FIG 1. is a top plan view of a corrugated carton separating apparatus according to the teachings of the present invention, illustrating a carton supply station and a carton separating station of the apparatus.

The invention relates to a method and apparatus for automatically separating folded two-on type corrugated cartons. Referring to FIG. 1, two-on cartons are indicated generally at 20 and each comprises two cartons 22 and 24 which are manufactured as a unitary structure but are adapted to be detached one from the other. In the manufacture of a two-on carton, the carton is initially die stamped from a sheet of corrugated material and then glued and folded to the flat configuration shown. At this point, the two cartons 22 and 24 are releasably connected by small bridges of cardboard material extending between the cartons along adjacent edges 26 and 28. The two-on carton 20 is similar configured on its opposite side, and if it is gripped along opposite edges and pulled apart, the bridges tear and the cartons 22 and 24 will be separated one from the other.

Figure 4:
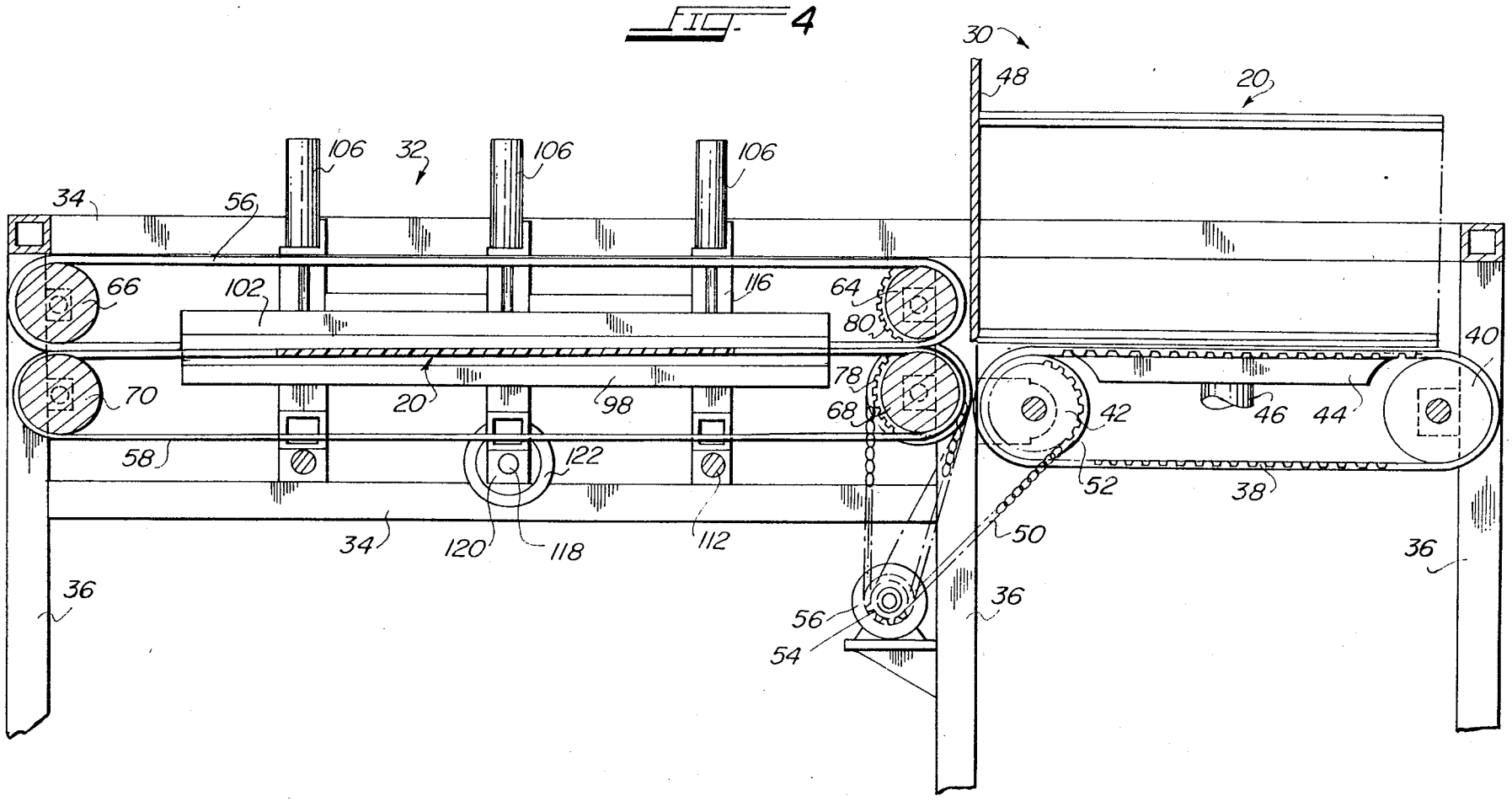
FIG. 4 is a cross sectional side elevation view taken substantially along the lines 4—4 of FIG. 3, and illustrates structural details of conveyors for moving cartons through the separating apparatus.

Referring in particular to FIGS. 1 and 4, the apparatus comprises a two-on carton supply station indicated generally at 30, and a carton separating station indicated generally at 32, defined within a frame 34 carried by a plurality of supports 36. The carton supply station includes a vacuum feed table having a perforated conveyor belt 38 carried on a pair of rolls 40 and 42, and a plenum 44 beneath the upper portion of the belt and connected with a source of vacuum through a line 46 for generating a vacuum along and through the upper surface of the belt. A stack of two-on cartons 20 is supported on the belt and a vertically extending partition 48 between the supply and separating stations has its lower end spaced above the upper surface of the belt by a distance slightly greater than the thickness of a carton. The conveyor belt 38 is operated by means of a chain 50 extending between a sprocket 52 on the roll 42 and a sprocket 54 on an output shaft of a motor 56, whereby energization of the motor drives the belt. The arrangement is such, by virtue of the vacuum drawn through the belt and the limited spacing of the lower end of the partition above the belt, that upon the belt being driven the lowermost carton is stripped from beneath the remainder of the stack and carried under the partition to the carton separating station, whereby cartons of the stack may be advanced seriatim to the separating station.

Figure 2:
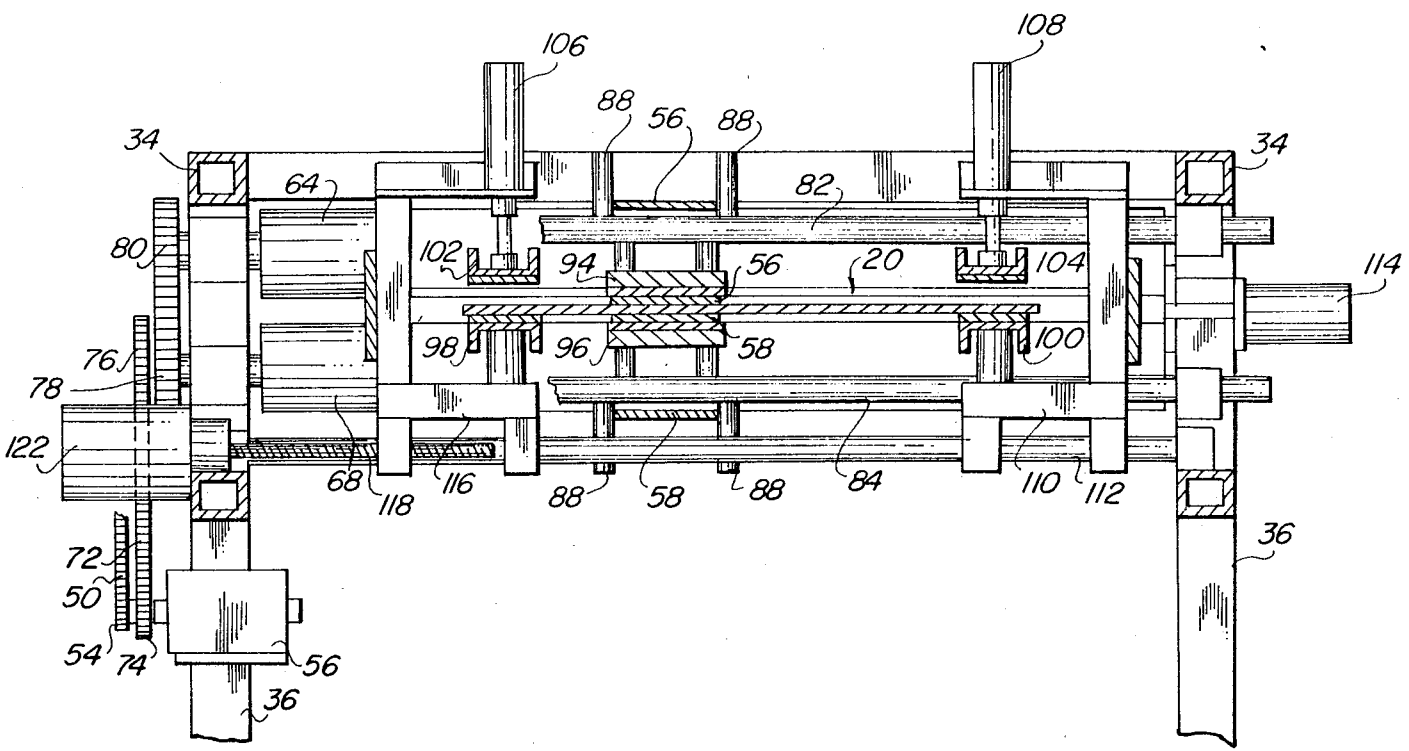
FIG. 2 is a cross sectional side elevation view taken substantially along the lines 2—2 of FIG. 1, and particularly shows a pair of clamps at the separating station in open position for gripping opposite edges of a carton.

Referring also to FIG. 2, as each two-on carton 20 moves beneath the partition 48, it is received between a pair of conveyor belts 56 and 58 which carry the carton forwardly until its front edge is detected by a photodetector 62 (FIG. 1). The upper belt 56 is carried by a pair of rolls 64 and 66 and the lower belt 58 by a pair of rolls 68 and 70, the rolls being suitably journaled for rotation on the frame 34. A chain 72 extends between a sprocket 74 on the output shaft of the motor 56 and a sprocket 76 on the roll 68, and the rolls 68 and 64 carry intermeshed gears 78 and 80, whereby energization of the motor also drives the conveyor belts 56 and 58.

To guide the conveyor belts 56 and 58 on the rolls 64, 66, 68 and 70 to control the position of the belts transversely of the separating station, a pair of vertically spaced rods 82 and 84 extend transversely across the apparatus toward the entrance end of the separating station and a similar pair of rods, only the upper rod 82 of which is shown, extend transversely across the apparatus toward the exit end of the separating station. Each rod carries a pair of belt guide posts 88, and opposite ends of the upper portion of the upper belt 56 are received within the posts in the upper rods while opposite ends of the lower portion of the lower belt 58 are received between the posts in the lower rods, whereby the transverse position of the belts with respect to the separating station is determined by the transverse positions of the posts 88. To control the positions of the posts, means 90 and 92 are provided for moving the rods 82 and 84 transversely of the apparatus to thereby move the belts. The particular means employed does not form a specific part of the invention, and may comprise any suitable mechanism as would be understood by one skilled in the art, e.g., a simple screw drive meshed with threads on the rods.

To ensure that the two-on cartons 20 are properly gripped by and between the conveyor belts 56 and 58 as they are advanced from the supply station 30, as seen in FIG. 2 the upper rods 82 carry an elongate belt backup support 94 extending therebetween and the lower rods 84 carry an elongate belt backup support 96. The support 94 extends longitudinally along the belt 56 immediately above its lower portion and the support 96 extends longitudinally along the belt 58 immediately beneath its upper portion, such that facing portions of the belts are limited to a maximum spacing which ensures that a two-on carton will be properly gripped thereby. Since the supports are carried by the rods, they always remain aligned with the belts irrespective of the particular adjustment of the belts transversely of the separating station 32.

The photodetector 62 connects to an appropriate circuit (not shown) for controlling energization of the motor 56, and as each successive two-on carton 20 is advanced from the supply station 30 to the separating station 32 and conveyed forwardly by the belts 56 and 58 to the point where the photodetector senses the front edge of the carton and stops the belts, as best seen in FIGS. 1 and 2, opposite side edges of the carton are moved between air cylinder actuated clamps on opposite sides of the separating station. Each clamp includes a pair of elongate soft durometer shoes, lower shoes 98 and 100 of which are fixed against vertical movement and upper shoes 102 and 104 of which are movable toward and away from the lower shoes by three air cylinders 106 connected to the shoe 102 and three air cylinders 108 connected to the shoe 104. The right clamp (FIG. 2) is carried by a bracket 110 which is slidably mounted toward its opposite ends on guide rods 112 and reciprocable transversely of the separating station along the guide rods between first and second positions by an air cylinder 114 mounted on the frame 34 and having its plunger connected to the bracket. The left clamp (FIG. 2) is carried by a bracket 116 which is also slidably mounted on the guide rods 112 for adjustable movement transversely of the separating station by means of a screw 118 threadably engaged with a nut 120 on the bracket and rotatable by any suitable means 122, e.g., by a motor or hand crank. Adjustment of the left clamp advantageously enables the apparatus to accommodate two-on cartons of various sizes, such that when a folded carton is introduced into the separating station its opposite edges will be positioned between the two clamps when the plunger of the cylinder 114 is extended and the right clamp is in its leftmost position.

Figure 3:
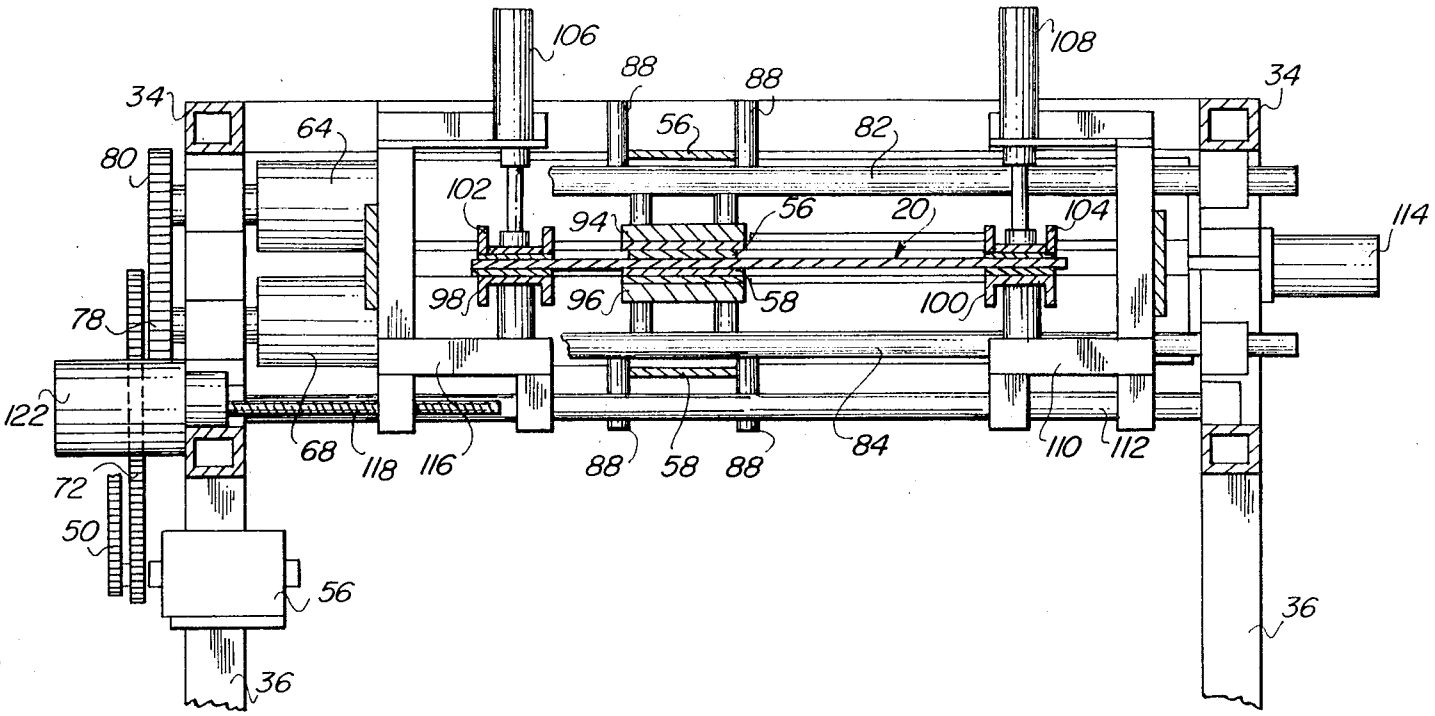
FIG. 3 is similar to FIG. 2, except that the clamps are closed and gripping the carton side edges.

FIGS. 1 and 2 illustrate a two-on carton 20 advanced from the supply station 30 to the separating station 32 and to the position where its forward edge is sensed by the photodetector 62. At this point, opposite edges of the two-on carton, which are respective edges of the still interconnected cartons 22 and 24, are between the open clamps. The pneumatic cylinders 106 and 108 are then actuated to close the clamps as shown in FIG. 3, whereupon the pneumatic cylinder 114 is actuated to move the left clamp toward the side of the machine so that the bridges of material between the edges 26 and 28 of the cartons 22 and 24 are broken and the cartons 22 and 24 are pulled apart and separated one from the other. The cylinder 114 is then actuated to return the left clamp to its initial position to bring the now separated cartons back together, the pneumatic cylinders 106 and 108 are actuated to open the clamps and the motor 56 is energized to operate the perforated belt 38 and the center belts 56 and 58 to expel the separated cartons from a downstream or exit end of the separating station for collection while simultaneously advancing the next successive two-on carton 20 from the supply station to the separating station for being operated upon as above described.

As should now be apparent, the two separating station conveyor belts 56 and 58 are adjusted transversely of the station in accordance with the particular configuration of the two-on cartons to be separated, so that the belts do not impede separation by gripping the cartons along their lines of separation. Also, to ensure some spacing between sequential two-on cartons so that the forward edge of each successive carton will be sensed by the photodetector 62, by an appropriate selection of sprocket sizes the two belts 56 and 58 are operated at a speed slightly greater than that of the vacuum feed conveyor belt 38.

While one embodiment of the invention has been described in detail, various modifications and other embodiments thereof may be devised by one skilled in the art without departing from the spirit and scope of the invention, as defined in the appended claims.

What is claimed is:

1. Apparatus for separating folded two-on corrugated cartons, comprising a pair of clamps; means extending between a supply of folded two-on cartons and said clamps for conveying folded two-on cartons seriatim from the supply to said clamps and for positioning opposite edges of each two-on carton for being gripped by a respective one of said clamps; and means coupled with said clamps for operating said clamps to sequentially grip the opposite edges of each two-on carton, to move said clamps relative to and away from each other to pull the two-on carton apart into two separate cartons, and to then release the separated cartons, said conveying means also conveying the separated cartons away from said clamps after said clamps release the cartons.

2. Apparatus as in claim 1, wherein said operating means also operates said clamps to move the same relative to and toward each other, immediately prior to releasing the cartons, to move the separated cartons back together.

3. Apparatus as in claim 1, wherein the supply of two-on cartons are in a stack and said means for conveying includes a vacuum feed table for supporting the stack of folded two-on cartons and for advancing successive cartons from the stack to said clamps.

4. Apparatus as in claim 3, wherein said vacuum feed table of said conveying means includes a perforated conveyor belt for supporting the stack of cartons, means for drawing a vacuum through said perforated belt to attract the lowermost carton of the stack to said perforated belt, means for blocking all but the lowermost carton of the stack against movement with said perforated belt, and means for intermittently operating said perforated belt to strip successive lowermost cartons from the stack, and wherein said means for conveying also includes conveyor belt means in line with a two-on carton discharge end of said perforated belt and extending between said perforated belt discharge end and said clamps for receiving each successive two-on carton from said perforated belt and delivering the same to said clamps for being pulled apart into two separate cartons.

5. Apparatus for separating folded two-on corrugated cartons, comprising a folded two-on carton supply station, said supply station including first conveyor means for advancing two-on cartons seriatim out of said supply station; and a two-on carton separating station, said separating station including a pair of clamps, second conveyor means in line with a two-on carton discharge end of said first conveyor means and extending between said first conveyor means and said clamps for receiving successive two-on cartons from said first conveyor means and for conveying each carton to said clamps, and means coupled with said clamps for operating said clamps to sequentially grip opposite edges of each two-on carton conveyed thereto, to move said clamps relative to and away from each other to pull the two-on carton apart into two separate cartons and to then release said clamps from gripping the separated cartons, said second conveyor means also conveying the separated cartons away from said clamps after said clamps release the same while said first conveyor means simultaneously advances the next successive two-on carton to said second conveyor means.

6. Apparatus as in claim 5, wherein the supply of folded two-on cartons are in a stack and said first conveyor means includes a perforated conveyor belt for supporting the stack of two-on cartons, means for drawing a vacuum through said perforated belt to attract the lowermost two-on carton of the stack to said perforated belt, means for blocking all but the lowermost two-on carton of the stack against movement with said perforated belt, and means for intermittently operating said perforated belt to strip successive lowermost cartons from the stack and deliver the same to said second conveyor means, said second conveyor means receiving each successive two-on carton and delivering the same to said clamps for being pulled apart into two separate cartons.

7. Apparatus as in claim 5, wherein said second conveyor means includes a pair of juxtaposed conveyor belts for receiving therebetween successive two-on cartons from said perforated conveyor belt.

8. Apparatus as in claim 5, including photoelectric means for sensing the presence of two-on cartons conveyed to said clamps and for interrupting operation of said second conveyor means in response to the cartons being in position to be gripped by said clamps.

9. A method of separating folded two-on corrugated cartons, comprising the steps of advancing successive two-on cartons to a separating station and, at the separating station, terminating the advancing step, mechanically gripping and pulling opposite edges of each successive two-on carton to pull the two-on carton apart into two separate cartons, releasing the edges of the separated cartons, and then conveying the released and separated cartons out of the separating station to a collection point while simultaneously advancing the next successive two-on carton to the separating station.

10. A method as in claim 9, wherein said advancing step comprises the steps of supporting a stack of folded two-on cartons on a first conveyor, intermittently operating the first conveyor to advance successive two-on cartons from the stack to a separating station conveyor, and intermittently operating the separating station conveyor to carry each successive two-on carton received from the first conveyor to a position for being mechanically gripped and pulled apart.

11. A method as in claim 10, including the further steps of sensing when each successive two-on carton has been carried by the separating station conveyor to the position for being mechanically gripped and pulled apart and, in response thereto, terminating operation of the separating station conveyor.

12. A method as in claim 10, wherein said step of supporting a stack of two-on cartons on a first conveyor comprises supporting the stack on a perforate conveyor, drawing a vacuum through the conveyor to attract the lowermost carton of the stack, and blocking all but the lowermost carton of the stack against movement with the perforate conveyor, so that upon performance of said first conveyor operating step the lowermost carton of the stack is stripped from beneath the stack and advanced to the operating station conveyor.

* * * * *